US006067921A

United States Patent [19]

Weber

[11] Patent Number: 6,067,921

[45] Date of Patent: May 30, 2000

[54] DEVICE FOR EXTERNAL CLEANING OF SHIP'S HULLS

[76] Inventor: Manfred Weber, Benfleetstrasse 9, Köln, Germany

[21] Appl. No.: 09/171,630

[22] PCT Filed: Apr. 25, 1997

[86] PCT No.: PCT/DE97/00834

§ 371 Date: Oct. 22, 1998

§ 102(e) Date: Oct. 22, 1998

[87] PCT Pub. No.: WO97/41026

PCT Pub. Date: Nov. 6, 1997

[30] Foreign Application Priority Data

Apr. 26, 1996 [DE] Germany ..... 296 07 426

[51] Int. Cl.[7] ..... B63B 59/00

[52] U.S. Cl. ..... 114/222

[58] Field of Search ..... 114/222; 15/179

[56] References Cited

U.S. PATENT DOCUMENTS

| | | | |
|---|---|---|---|
| 3,709,184 | 1/1973 | Laney | 114/222 |
| 4,236,477 | 12/1980 | Norris et al. | 114/222 |
| 4,510,639 | 4/1985 | Roncaglione | 15/179 |
| 4,843,995 | 7/1989 | Bingham | 114/222 |

FOREIGN PATENT DOCUMENTS

| | | | |
|---|---|---|---|
| 3641939 | 6/1988 | Germany | 114/222 |

*Primary Examiner*—Stephen Avila

[57] ABSTRACT

In order to be able to dispense with the time-consuming and expensive manual cleaning of ship's hulls (4), a cleaning installation is proposed which consists of at least one cleaning roller (2, 3) which can be driven to rotate, is rotatably mounted in a rack (1) and whose roller structures are positioned at least partially below the surface of the water.

15 Claims, 3 Drawing Sheets

DEVICE FOR EXTERNAL CLEANING OF SHIP'S HULLS

The present application claims priority from copending application Ser. No. PCT/DE97/00834 filed on Apr. 25, 1997 and Fed. Rep. Of Germany application No. 296 07 426.8 filed Apr. 26, 1996.

BACKGROUND OF THE INVENTION

The invention relates to a device for the external cleaning of ship's hulls.

Over time, numerous forms of life, such as algae, crustaceans, corals and the like, colonise the hulls of ships and yachts below or at the waterline, depending on the nature of the body of water. This may damage the hull material under certain circumstances, and always has a negative effect on the hydrodynamic resistance of the ship's hull, thus impairing the performance of the ship or, in the case of motor-driven ships, resulting in increased fuel consumption.

For this reason, ships have heretofore been lifted out of the water with hoisting gear about once a year and the accumulated incrustation removed manually.

According to the prior art, in order to limit or prevent colonisation of the ship's hull by living organisms, the hulls are also treated regularly with a so-called "anti-fouling" coating made of highly toxic substances, the inhibiting effect of which subsides relatively quickly, however, due to the fact that the substances used must also always be at least slightly water-soluble in order to have a toxic effect on the organisms. The use of toxic substances of this kind is problematic from the standpoint of environmental protection.

SUMMARY OF THE INVENTION

The necessary manual cleaning of ship hulls is relatively time-consuming and generates substantial costs. In addition, it can usually only be carried out at expensive berths where the corresponding hoisting cranes are available.

The invention is based on the task of designing a device for the external cleaning of ship's hulls, with which cleaning work of this nature can be performed more quickly and inexpensively. According to the invention, this task is solved by at least one cleaning roller which can be driven to rotate, is rotatably mounted in a rack and whose roller structures are positioned at least partially below the surface of the water.

In this context, the surface of the cleaning roller is preferably designed such that, when rotating, it has an abrasive effect on the accumulated layers of living organisms, but does not risk damaging the hulls, which are generally made of glass fibre-reinforced plastic (GRP). Possible alternatives include, in particular, brush rollers, loop rollers, rollers with roughened surfaces or rollers coated with grinding or abrasive substances.

Although it is possible, in principle, to clean an entire hull with a single cleaning roller, one or more roller pairs are preferably provided, whose individual rollers are positioned respectively on the starboard and port sides. The required cleaning time can be drastically reduced in this way.

Standard ship hulls come to a relatively acute angle at the bow, while they form a flat or obtuse angle at the stern. For this reason, it can be expedient to mount consecutive pairs of brushes at different angles.

A space is preferably provided between the individual rollers of a brush pair, so that the keel or centre-board of a ship can be drawn through it.

In order to be able to exert even pressure on all areas of the hull, but also in order to be able to clean different hulls with the same device, the roller structures and axles of the cleaning rollers are preferably designed to be flexible and adaptable to the hull shape. To this end, the axles can be constructed of segments, for example, where the segments are connected to one another via spring elements, for instance. Axle and roller structures made of elastic plastic or rubber materials are also suitable for this purpose.

The rack for supporting or accommodating the cleaning rollers can be borne by floats, but is preferably positioned in the water in fixed fashion, such as with the help of anchors. The ship is then pulled through the cleaning installation using a windlass or the like, for example, where the forward speed can be adapted to the thickness or nature of the contamination and marine fouling.

On the other hand, it is also possible to firmly anchor the ship and mount the cleaning rollers in movable fashion along the longitudinal direction of the ship.

In order to adapt to different hulls, it is additionally advantageous to be able to move the cleaning rollers towards the hull in the rack. For this same reason, the angle of the roller structures and roller axles to the vertical should be adjustable.

The drive motors and the motors for adjusting the cleaning rollers are preferably mounted above the surface of the water and can be mounted, for example, on the rack for the cleaning rollers. In order to drive the cleaning rollers, the drive motors are connected to them by standard drive arrangements, such as toothed belts, bevel gears or the like, thus ensuring that the drives, bearings and other movable parts, can function under water.

The drive motors or servomotors are preferably designed as encased electric motors. Hydraulic or pneumatic motors can likewise be used. In the case of automatic cleaning installations, the motors can be regulated or controlled by sensors, for example, which respond to the size, shape and position of the ship's hull.

In addition to cleaning rollers, circulating cleaning belts, which are guided over the hull with the help of corresponding drives, can also be used.

An example of the invention is illustrated in the drawings and described in detail below based on the drawings. The drawings show the following:

DESCRIPTION OF THE PREFERRED EMBODIMENTS

Figure 1:
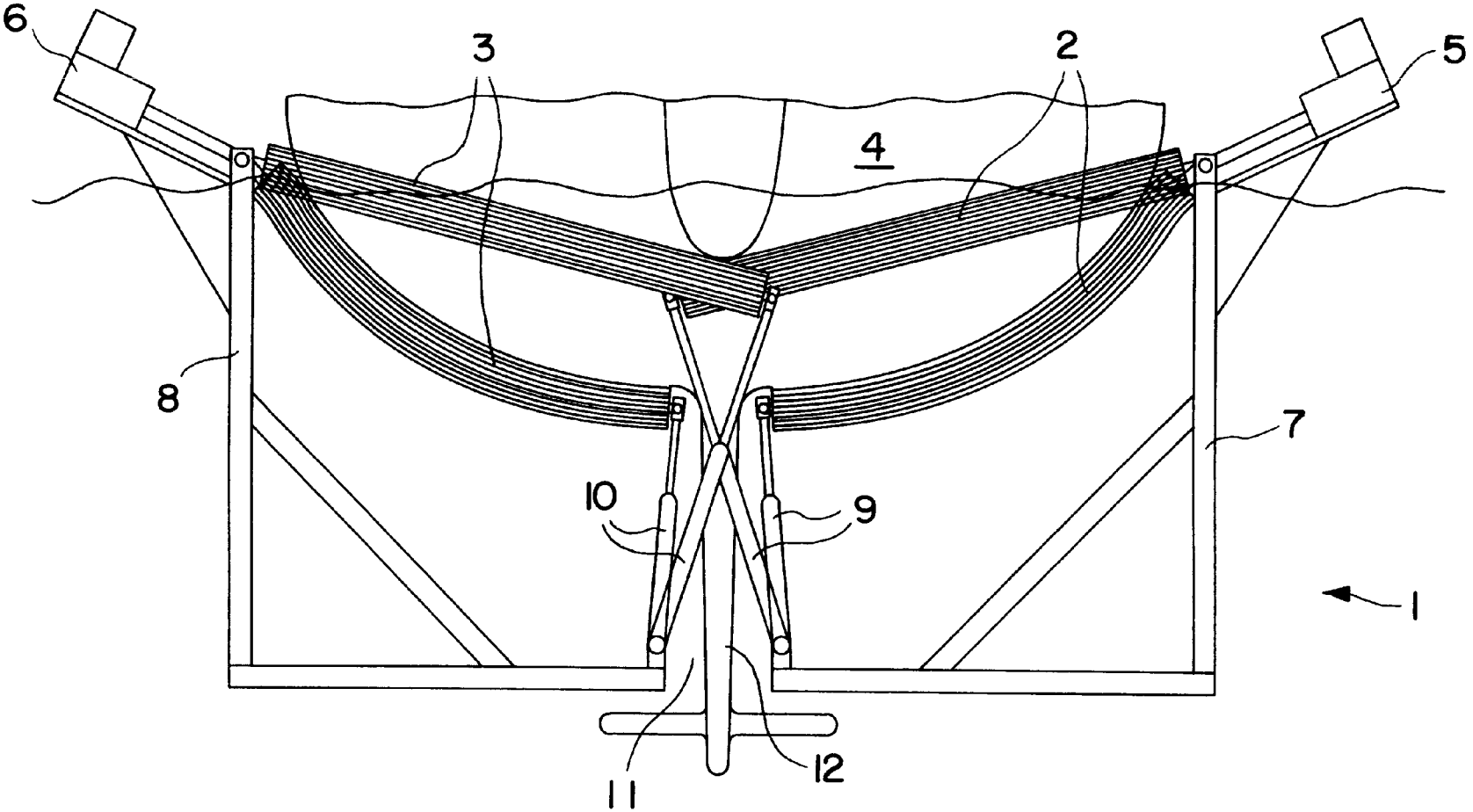
FIG. 1 A schematic illustration of a cleaning roller pair mounted on a rack in various positions for cleaning, FIG. 2 A top view of one of the cleaning rollers according to FIG. 1, FIG. 3 A longitudinal section through a cleaning roller according to FIGS. 1 and 2, and FIG. 4 A cross-section through a cleaning roller according to FIGS. 1 to 3.

The cleaning installation illustrated schematically in FIG. 1 consists of a rack 1, essentially mounted below the water level, in which two driven cleaning rollers 2, 3 are mounted perpendicular to the longitudinal direction of a ship's hull 4. Cleaning rollers 2, 3 are driven by motors 5, 6, which are positioned above the water level and connected to electric, pneumatic or hydraulic supply lines (not shown).

Cleaning rollers 2, 3 are elastically deformable along their longitudinal axis and their upper ends are pivot-mounted on side arms 7, 8 of rack 1. The ends of cleaning rollers 2, 3 located below the water level are borne by control cylinders 9, 10 which are of variable length and pivot-mounted on rack 1.

FIG. 1 shows the position of cleaning rollers 2, 3 in the top position when hull 4 is being driven in, i.e. at the bow, and in the bottom position which they are in when cleaning the widest point of the hull.

Rack 1 has a centre opening 11, through which, for example, keel 12 of hull 4 can be pulled.

Figure 2:
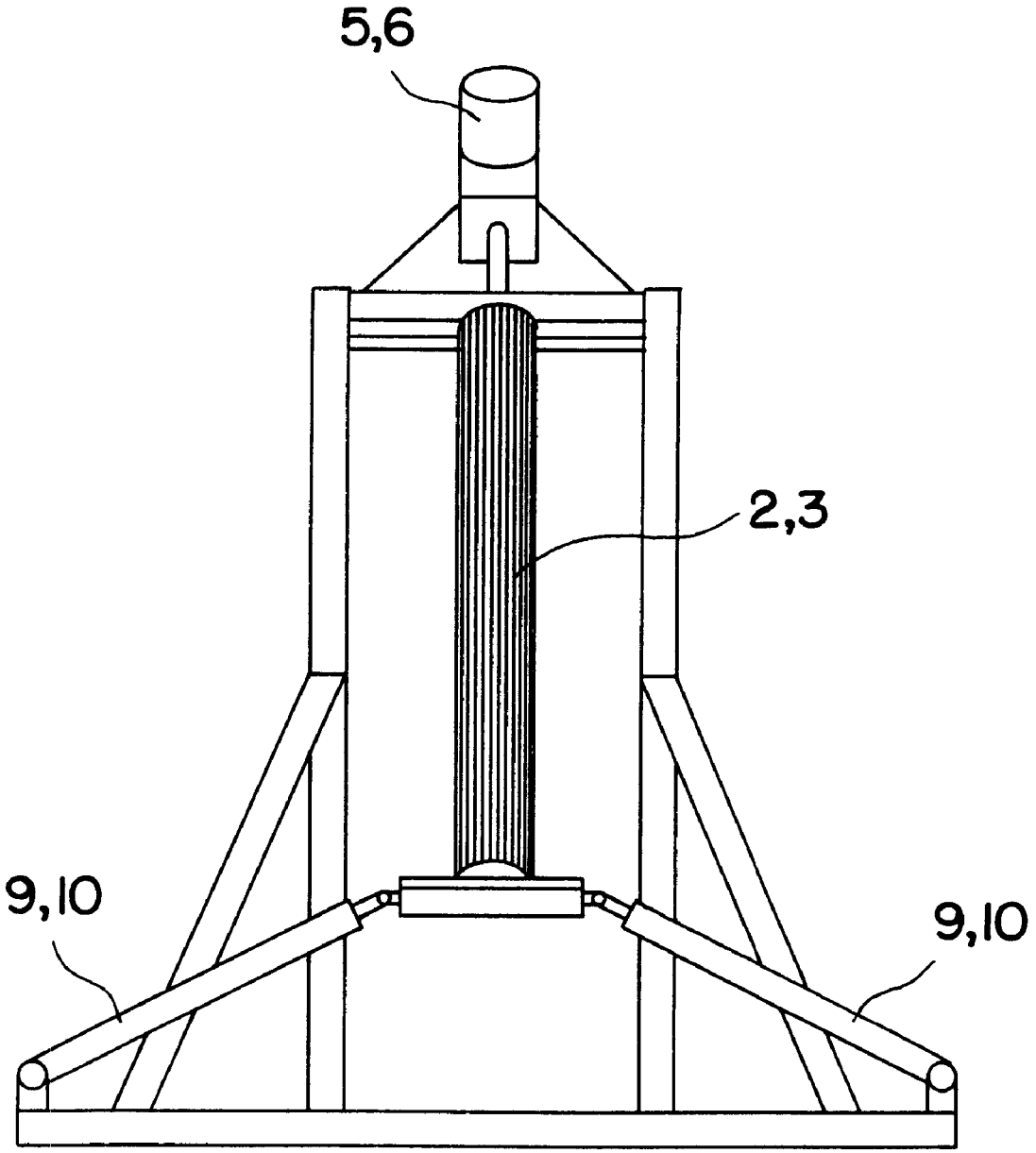

FIG. 2 shows a top view of one of cleaning rollers 2, 3. In particular, it clearly indicates the position of the control cylinders.

Figure 3:
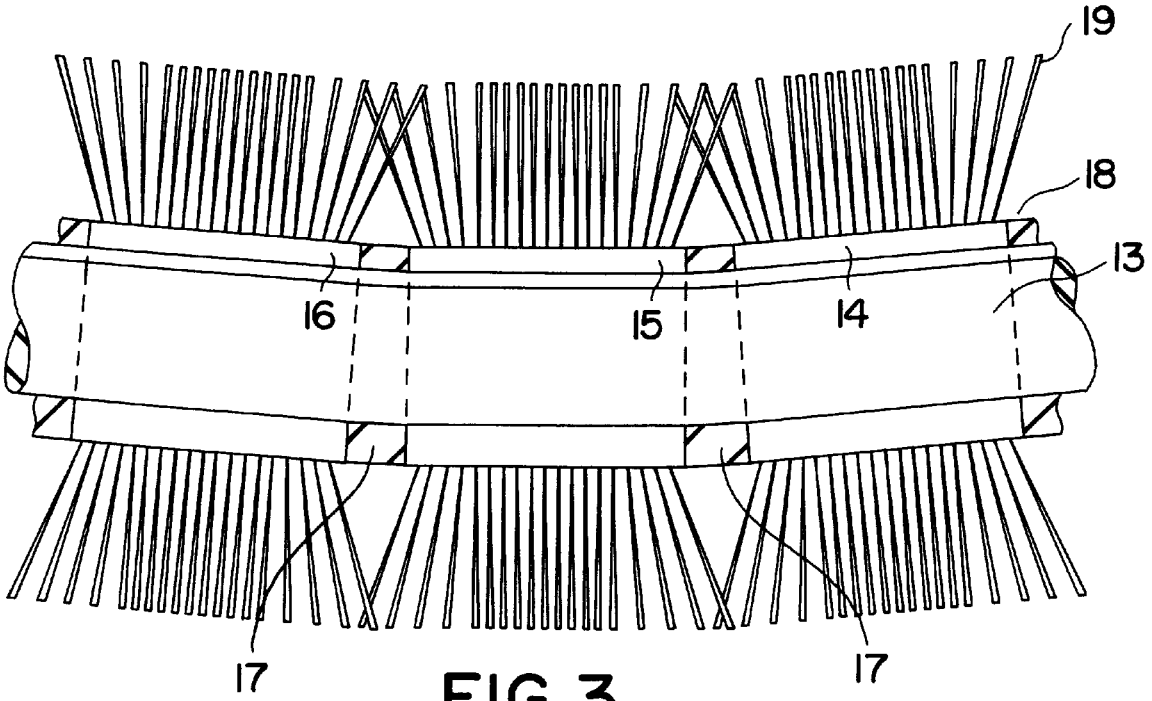
Figure 4:
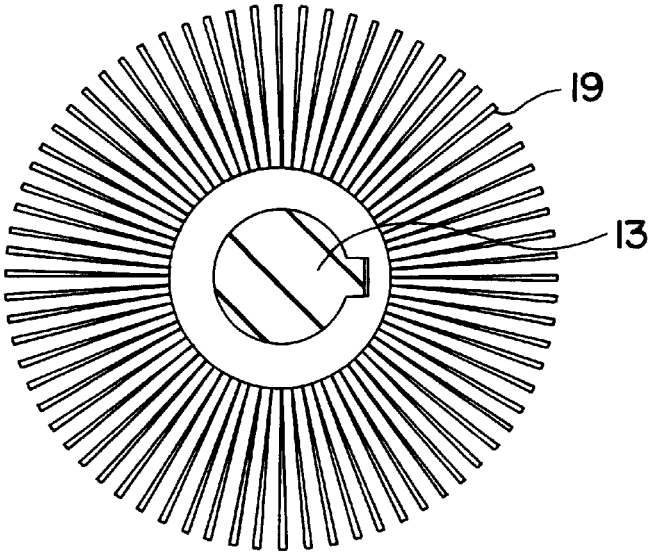

FIGS. 3 and 4 illustrate the structure of the cleaning rollers 2, 3 used. The roller consists of an elastically deformable core 13, which can be made of plastic or a flat coil spring, for example. Individual brush segments 14, 15, 16 are each mounted around core 13 in non-rotatable fashion and connected to one another by elastically deformable spacers 17. Outer surface 18 of brush segments 14, 15, 16 has bristle-like cleaning elements 19 extending in the radial direction.

Although a preferred embodiment of the invention has been specifically illustrated and described herein, it is to be understood that minor variations may be made in the apparatus without departing from the spirit and scope of the invention, as defined the appended claims.

What is claimed is:

1. A device for cleaning the exterior of a ship's hull comprising at least one cleaning roller (2, 3) adapted to be driven and being mounted for rotation relative to a rack (1), said at least one cleaning roller (2, 3) being defined by an elastically deformable core (13) located internally and nonrotatably relative to a plurality of individual brush segments (14, 15, 16), said at least one cleaning roller (2, 3) being adapted for positioning below water and conforming to a variety of differently shaped ship's hulls due to the elastically deformable nature of the core (13) and the individual brush segments (14, 15, 16) carried nonrotatably thereby, and a plurality of bristle-like cleaning elements (19) projecting substantially radially outwardly of and being disposed substantially peripherally about each brush segment (14, 15, 16).

2. The device for cleaning the exterior of a ship's hull as defined in claim 1 including means for pivoting a first end of said core (13) to said rack (1).

3. The device for cleaning the exterior of a ship's hull as defined in claim 1 including means for pivoting a first end of said core (13) to said rack (1), and said second means between a second end of said core (13) and said rack (1) for adjusting the position of the core's second end to accommodate differently shaped ship's hulls.

4. The device for cleaning the exterior of a ship's hull as defined in claim 1 including elastically deformable spacers (17) between adjacent brush segments (14, 15; 15, 16).

5. The device for cleaning the exterior of a ship's hull as defined in claim 1 including means (5, 6) for rotating said at least one cleaning roller (2, 3) through a first end of said core (13).

6. The device for cleaning the exterior of a ship's hull as defined in claim 2 including means (5, 6) for rotating said at least one cleaning roller (2, 3) through the first end of said core (13).

7. The device for cleaning the exterior of a ship's hull as defined in claim 3 including means (5, 6) for rotating said at least one cleaning roller (2, 3) through the first end of said core (13).

8. The device for cleaning the exterior of a ship's hull as defined in claim 4 including means (5, 6) for rotating said at least one cleaning roller (2, 3) through the first end of said core (13).

9. The device for cleaning the exterior of a ship's hull as defined in claim 2 including elastically deformable spacers (17) between adjacent brush segments (14, 15; 15, 16).

10. The device for cleaning the exterior of a ship's hull as defined in claim 3 including elastically deformable spacers (17) between adjacent brush segments (14, 15; 15, 16).

11. The device for cleaning the exterior of a ship's hull as defined in claim 3 wherein said second means include a piston-cylinder mechanism (22).

12. A device for cleaning the exterior of a ship's hull comprising first and second cleaning rollers (2, 3) each having first ends adjacent each other and second ends remote from each other, said cleaning rollers (2, 3) being supported by a rack (1) to substantially underlyingly transversely span a ship's hull, each roller (2, 3) being defined by an elastically deformable core (13) located internally and nonrotatably relative to a plurality of individual brush segments (14, 15, 16), said rollers (2, 3) being adapted to conform to a variety of differently shaped ship's hulls due to the elastically deformable nature of the cores (13) thereof, and the individual brush segments (14, 15, 16) carried nonrotatably thereby, a plurality of bristle-like cleaning elements (19) projecting substantially radially outwardly of and being disposed substantially peripherally about each brush segment (14, 15, 16), and means (5, 6) for rotating each core (13).

13. The device for cleaning the exterior of a ship's hull as defined in claim 12 wherein said driving means is connected to each core second end.

14. The device for cleaning the exterior of a ship's hull as defined in claim 12 including means connected between each roller first end and said rack for adjusting the rollers (2, 3) to accommodate differently shaped ship's hulls.

15. The device for cleaning the exterior of a ship's hull as defined in claim 13 including means connected between each roller first end and said rack for adjusting the rollers (2, 3) to accommodate differently shaped ship's hulls.

* * * * *